US007102336B2

(12) United States Patent
Adachi

(10) Patent No.: US 7,102,336 B2
(45) Date of Patent: Sep. 5, 2006

(54) VOLTAGE REGULATOR CIRCUIT HAVING SHORT-CIRCUIT PROTECTION CIRCUIT

(75) Inventor: Masahiro Adachi, Kanagawa (JP)

(73) Assignee: NEC Electronics Corporation, Kanagawa (JP)

( * ) Notice: Subject to any disclaimer, the term of this patent is extended or adjusted under 35 U.S.C. 154(b) by 0 days.

(21) Appl. No.: 11/072,229

(22) Filed: Mar. 7, 2005

(65) Prior Publication Data

US 2005/0194949 A1 Sep. 8, 2005

(30) Foreign Application Priority Data

Mar. 8, 2004 (JP) ..... 2004-064720

(51) Int. Cl.
*G05F 1/569* (2006.01)
*G05F 1/40* (2006.01)

(52) U.S. Cl. ..... 323/276; 323/284; 361/93.1

(58) Field of Classification Search ..... 323/222, 323/274, 276, 280, 282, 284, 285; 361/87, 361/93.1

See application file for complete search history.

(56) References Cited

U.S. PATENT DOCUMENTS 5,596,465 A * 1/1997 Honda et al. ..... 323/284

6,603,292 B1 * 8/2003 Schouten et al. ..... 323/274

FOREIGN PATENT DOCUMENTS

JP 2003-173211 A 6/2003

* cited by examiner

*Primary Examiner*—Jessica Han
(74) *Attorney, Agent, or Firm*—Sughrue Mion, PLLC

(57) ABSTRACT

A voltage regulator circuit includes a regulator circuit and a short-circuit protection circuit. The regulator circuit includes a first transistor and a first amplifier. The first amplifier outputs a gate voltage to a gate of the first transistor in response to a reference potential and a feedback potential such that the feedback potential coincides with the reference potential. The feedback potential is a fed back potential from the first transistor. The short-circuit protection circuit includes a second transistor, a first resistance, a second resistance and a second amplifier. The gate voltage is supplied to a gate of the second transistor. The first resistance connects a first terminal of the second transistor with a ground. The second resistance connects a second terminal of the second transistor with a power source. The second amplifier outputs a control voltage to the first amplifier in response to a bias potential and a potential of the first terminal to control the gate voltage.

12 Claims, 6 Drawing Sheets

VOLTAGE REGULATOR CIRCUIT HAVING SHORT-CIRCUIT PROTECTION CIRCUIT

BACKGROUND OF THE INVENTION

1. Field of the Invention

The present invention relates to a voltage regulator circuit having a short-circuit protection circuit. More particularly, the present invention relates to a voltage regulator circuit having a short-circuit protection circuit which can limit an output current.

2. Description of the Related Art

A voltage regulator circuit which outputs a predetermined current at a predetermined voltage in response to an input voltage is widely used in electronic devices.

The voltage regulator circuit is the circuit which converts an output current of a driver into a voltage, feeds the voltage back to a differential amplifier, compares the feedback voltage with a reference voltage, and adjusts a drive voltage of the driver based on a comparison result, and then outputs a predetermined current at a predetermined voltage from an output terminal.

In such a voltage regulator circuit, if any reason (for example, solder bridge) causes the short-circuit between the output terminal of the driver and a ground, the feedback voltage becomes 0V. In this case, the differential amplifier continues the action to increase the drive voltage of the driver. If the differential amplifier continues this action, there may be a case that the circuit is broken by Joule heat generation.

For this reason, typically, the voltage regulator circuit has a short-circuit protection circuit for stopping the operation of the differential amplifier if a trouble such as an earth fault of the output terminal or the like occurs. Here, the earth fault of the output terminal is the short-circuit to the ground.

In conjunction with the voltage regulator circuit having the short-circuit protection circuit, a conventional technique of a regulator is disclosed in Japanese Laid Open Patent Application JP 2003-173211A.

FIG. 1 is a circuit diagram showing the configuration of the voltage regulator circuit having the short-circuit protection circuit according to the conventional technique. This voltage regulator circuit 101 includes a regulator circuit 102 and a short-circuit protection circuit 103. The regulator circuit 102 includes a reference voltage source 111, an amplifier 112, a MOS transistor 113, a resistance 114 and a resistance 115. The short-circuit protection circuit 103 includes an amplifier 122, a MOS transistor 123 and a resistance 124.

This voltage regulator circuit 101 divides the output voltage from the MOS transistor 113 and feeds a divided voltage $V_b$ back to the amplifier 112. The amplifier 112 controls a gate voltage of the MOS transistor 113 such that a reference voltage $V_{REF}$ supplied from the reference voltage source 111 coincides with the feedback voltage $V_b$.

The output voltage $V_{IN}$ from the amplifier 112 is supplied to both of the MOS transistor 113 and the MOS transistor 123 as a gate voltage $V_g$.

A current value $I_L$ based on the output current of the MOS transistor 123 is voltage-converted into a voltage $V_a$ based on the resistance 124 and supplied to the amplifier 122. Also, the feedback voltage $V_b$ that is fed through a voltage division resistor 114 to the amplifier 112 is also supplied to the amplifier 122. In the voltage regulator circuit 101 having the above-mentioned configuration, an output current $I_{OUT}$ of the MOS transistor 113 when the short-circuit protection circuit 102 is operated is represented by an equation (1).

Incidentally, in the equation (1), μ indicates an electron mobility in the MOS transistors 113, 123. $C_{OX}$ indicates a fixed capacity of the gate insulating films in the MOS transistors 113, 123. $W_1$ and $L_1$ indicate a channel width and a channel length of the MOS transistors 113. $W_2$ and $L_2$ indicate a channel width and a channel length of the MOS transistors 123. $R_{a1}$ indicates a resistance value of the resistance 124.

[Equation (1)]

$$I_{OUT} = \frac{W_1}{L_1} \cdot k \cdot \frac{V_b \cdot L_2}{R_{a1} \cdot W_2 \cdot k} \tag{1}$$

$$k = \mu \cdot C_{0X} \cdot \frac{1}{2}$$

As can be seen from the equation (1), in the voltage regulator circuit 101 having the above-mentioned configuration, the output current $I_{OUT}$ from the MOS transistor 113 is a function inversely proportional to the resistance value $R_{a1}$ of the resistance 124 in the short-circuit protection circuit 103.

In a manufacturing process of a semiconductor device, an absolute value of a circuit element is largely varied. For example, since a variation in a patterning process and a variation in a diffusing process are overlapped, it is difficult to attain the values in a design. The actually produced circuit element contains an error of about ±30%.

In the voltage regulator circuit 101 having the conventional short-circuit protection circuit 103, the output current $I_{OUT}$ from the MOS transistor 113 serving as the driver is represented as the function inversely proportional to the resistance value $R_{a1}$ of the resistance 124. It has now been discovered that the variation in the resistance value $R_{a1}$ directly corresponds to the variation in the output current $I_{OUT}$.

FIG. 2 is a graph showing the output property of the voltage regulator circuit having the short-circuit protection circuit according to the conventional technique. Incidentally, a curve "a" in the graph indicates a designed standard value of a short-circuit current, a curve "b" in the graph indicates the minimum condition of the short-circuit current, and a curve "c" in the graph indicates the maximum condition of the short-circuit current.

As illustrated, in the voltage regulator circuit 101 having the short-circuit protection circuit 103 according to the conventional technique, even if the drive currents of the driver are equal, there is a large variation in the values of the output currents $I_{OUT}$ actually outputted from the MOS transistor 113.

In order to remove such variation, the trimming must be performed to the resistance value $R_{a1}$ to adjust the resistor value. This causes the problems of the increase in the number of the processes in the manufacturing process of the voltage regulator circuit and the increase in the manufacturing cost.

Incidentally, the invention, which is disclosed in the JP 2003-173211A and is the short-circuit protection circuit having a blocking property, similarly to the above-mentioned case, the variation in the resistance value of the resistance results in the variation in the output current.

In this way, the voltage regulator circuit having the conventional short-circuit protection circuit has a problem that it is difficult to obtain the desirable circuit property because it receives the influence of the manufacture variation in the resistance value of the resistance.

SUMMARY OF THE INVENTION

Therefore, an object of the present invention is to provide a voltage regulator circuit having a short-circuit protection circuit in which an influence of a variation in an output current caused by a manufacture variation in a resistance can be reduced, and a method for operating a voltage regulator circuit.

In order to achieve an aspect of the present invention, the present invention provides a voltage regulator circuit including: a regulator circuit; and a short-circuit protection circuit, wherein the regulator circuit includes: a first transistor, and a first amplifier which outputs a gate voltage to a gate of the first transistor in response to an input of a reference potential and a feedback potential such that the feedback potential coincides with the reference potential, the feedback potential is an output potential of first transistor fed back to the first amplifier, the short-circuit protection circuit includes: a second transistor that the gate voltage is supplied to a gate, a first resistance which connects a first terminal of the second transistor with a ground, a second resistance which connects a second terminal of the second transistor with a power source, and a second amplifier which outputs a control voltage to the first amplifier in response to an input of a bias potential and a potential of the first terminal to control the gate voltage.

In order to achieve another aspect of the present invention, the present invention provides a method for operating a voltage regulator circuit, wherein the voltage regulator circuit including: a regulator circuit; and a short-circuit protection circuit, wherein the regulator circuit includes: a first transistor which includes a first gate, a third terminal outputting a output current, and a fourth terminal, and a first amplifier which includes a first output terminal connected with the first gate, a third input terminal connected with the third terminal such that a feedback potential corresponding to an output potential of the third terminal is fed back, and a fourth input terminal connected with a reference power source that supplies a reference potential, the short-circuit protection circuit includes: a second transistor which includes a second gate connected with the first output terminal, a first terminal and a second terminal, a first resistance which connects the first terminal with a ground, a second resistance which connects the second terminal with a power source, and a second amplifier which includes a second output terminal connected with a control terminal of the first amplifier, a first input terminal connected with the first terminal, and a second input terminal connected with the third terminal such that the feedback potential is supplied, the method including: (a) outputting the output current from the third terminal; (b) supplying the feedback potential to the third input terminal, and the reference potential to the fourth input terminal; and (c) outputting a gate voltage from the first output terminal to the first gate based on a potential of the first terminal and the feedback potential such that the feedback potential coincides with the reference potential.

In the present invention, the output current from the first transistor in the voltage regulator circuit is determined by not the resistance value of the first resistance but the ratio of the first resistance to the second resistance. This makes the manufacture variation of the resistances be cancelled. Therefore, by determining the output current from the first transistor based on the ratio of the first resistance to the second resistance, the influence of the manufacture variation can be avoided and the output property of the voltage regulator circuit can be stable.

According to the present invention, it is possible to provide the voltage regulator circuit having the short-circuit protection circuit in which the variation in the output current caused by the variation in the resistance value of the resistance element is small.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

Figure 1:
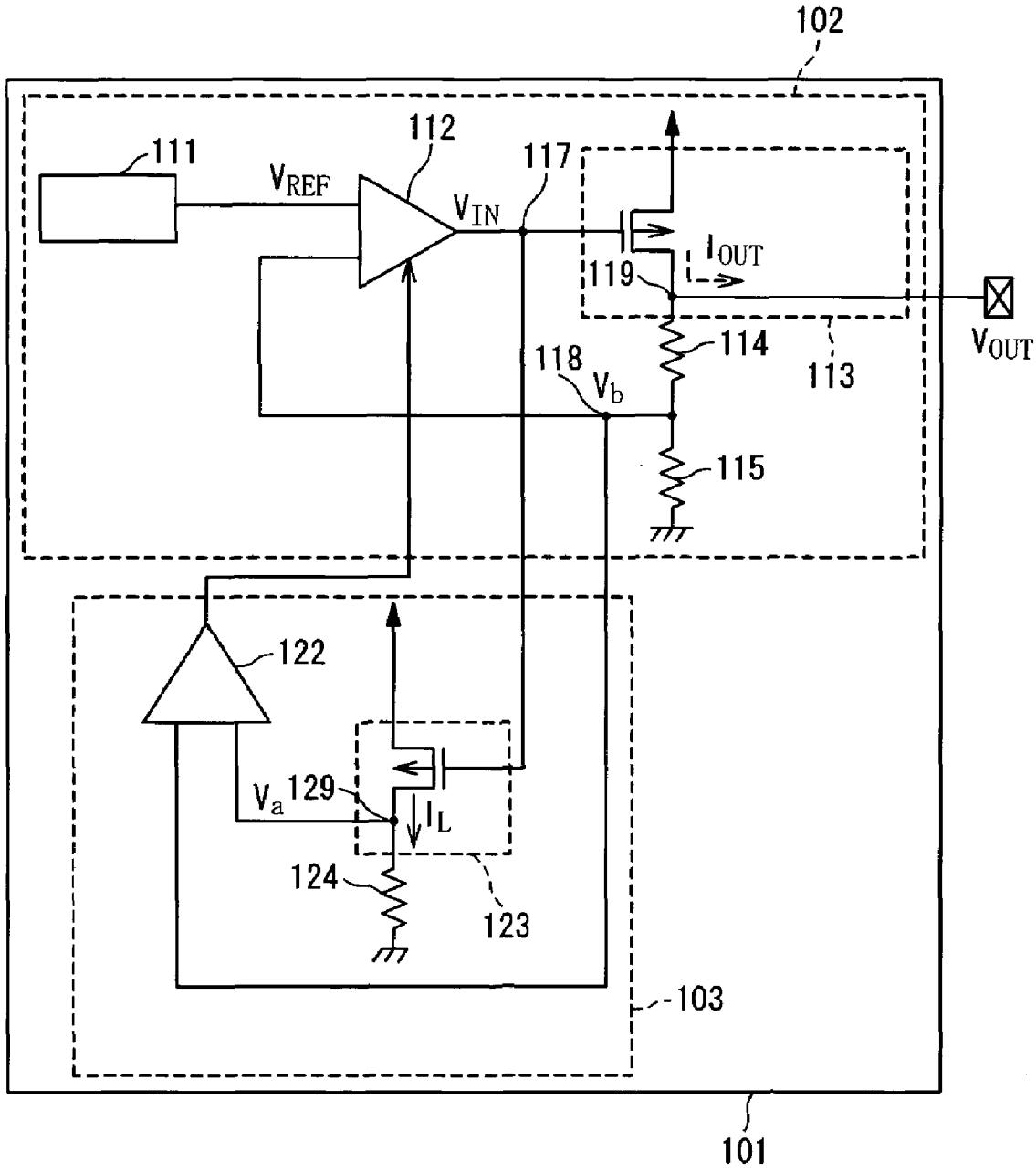
Fig. 1 PRIOR ART
FIG. 1 is a circuit diagram showing the configuration of the voltage regulator circuit having the short-circuit protection circuit according to the conventional technique.
Figure 2:
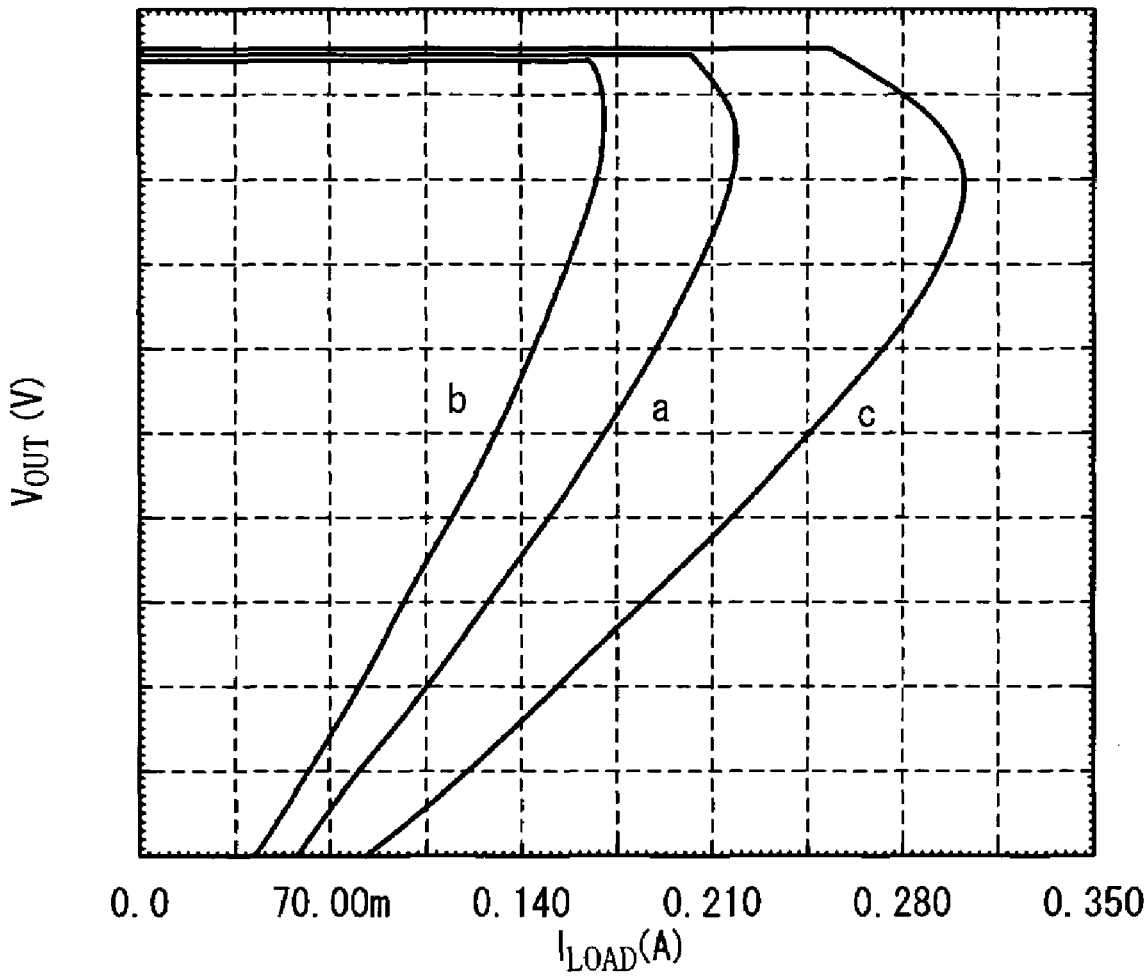
Fig. 2 PRIOR ART
FIG. 2 is a graph showing the output property of the voltage regulator circuit having the short-circuit protection circuit according to the conventional technique.
Figure 3:
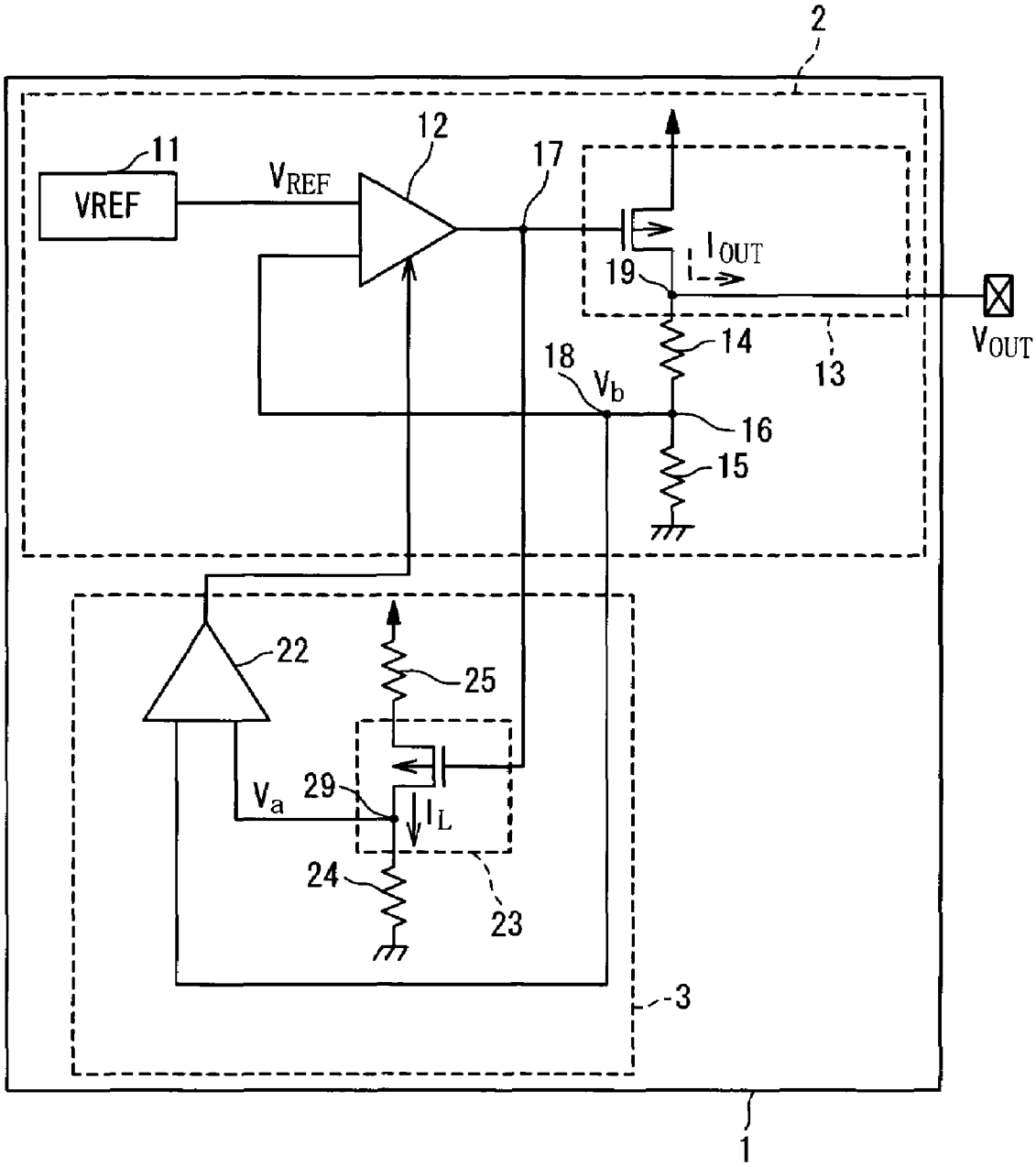
FIG. 3 is a circuit diagram showing a configuration of a voltage regulator circuit having a short-circuit protection circuit according to this embodiment.

Embodiments of a voltage regulator circuit having a short-circuit protection circuit according to the present invention will be described below with reference to the attached drawings. FIG. 3 is a circuit diagram showing a configuration of a voltage regulator circuit having a short-circuit protection circuit according to this embodiment.

This voltage regulator circuit 1 includes a regulator circuit 2 and a short-circuit protection circuit 3. The regulator circuit 2 includes a reference voltage source 11, a differential amplifier 12 (a first amplifier), a MOS transistor 13 (a first transistor), a third resistance 14 and fourth resistance 15. In the MOS transistor 13, a channel width is $W_1$ and a channel length is $L_1$. The short-circuit protection circuit 3 includes a MOS transistor 23 (a second transistor), an amplifier 22 (a second amplifier), a first resistance 24 and a second resistance 25. In the MOS transistor 23, a channel width is $W_2$ and a channel length is $L_2$.

In the voltage regulator circuit 2, the MOS transistor 13 serving as a driver includes a gate (a first gate), a fourth terminal connected with a power source (not show), and a third terminal outputting an output voltage $V_{OUT}$ at a node 19. The third resistance 14 is connected with the fourth resistance 15 at the node 16 (a first connection point). The third resistance 14 and the fourth resistance 15 function as the voltage dividing resistances, and the third resistance is connected with the MOS transistor 13 at the node 19. The third resistance 14 and the fourth resistance 15 divide the output voltage $V_{OUT}$ into an output voltage $V_b$ and an output voltage $(V_{OUT}-V_b)$. The output voltage $V_b$ at a node 16, corresponding to the output voltage $V_{OUT}$, is fed back to the differential amplifier 12. That is, the output voltage $V_{OUT}$ is fed back through the third resistance 14 to the differential amplifier 12 (negative feedback). The differential amplifier 12 controls a gate voltage of the MOS transistor 13 by the output voltage $V_{IN}$ such that a reference voltage $V_{REF}$ supplied from the reference voltage source 11 coincides with the feedback voltage $V_b$.

The output voltage $V_{IN}$ from the differential amplifier 12 is supplied as a gate voltage $V_g$ to both of the MOS transistor 23 and the MOS transistor 13. The MOS transistor 23 serving as a protection transistor includes a gate (a second gate), a first terminal connected with the first resistance 24 at a node 29, and a second terminal connected with the second resistance 25. A current value $I_L$ flowing through the MOS transistor 23 is voltage-converted into a voltage $V_a$ determined by a relative ratio between the first resistance 24 and the second resistance 25 at a node 29. The first resistance 24 and the second resistance 25 function as the voltage dividing resistances. The voltage $V_a$ is supplied to the amplifier 22. Also, the feedback voltage $V_b$ that is fed back from the output terminal (the node 19) of the MOS transistor 13 through the third resistance 14 to the differential amplifier 12 is also supplied to the amplifier 22 at the same time. THe amplifier outputs a control voltage to the differential amplifier 12

Figure 4:
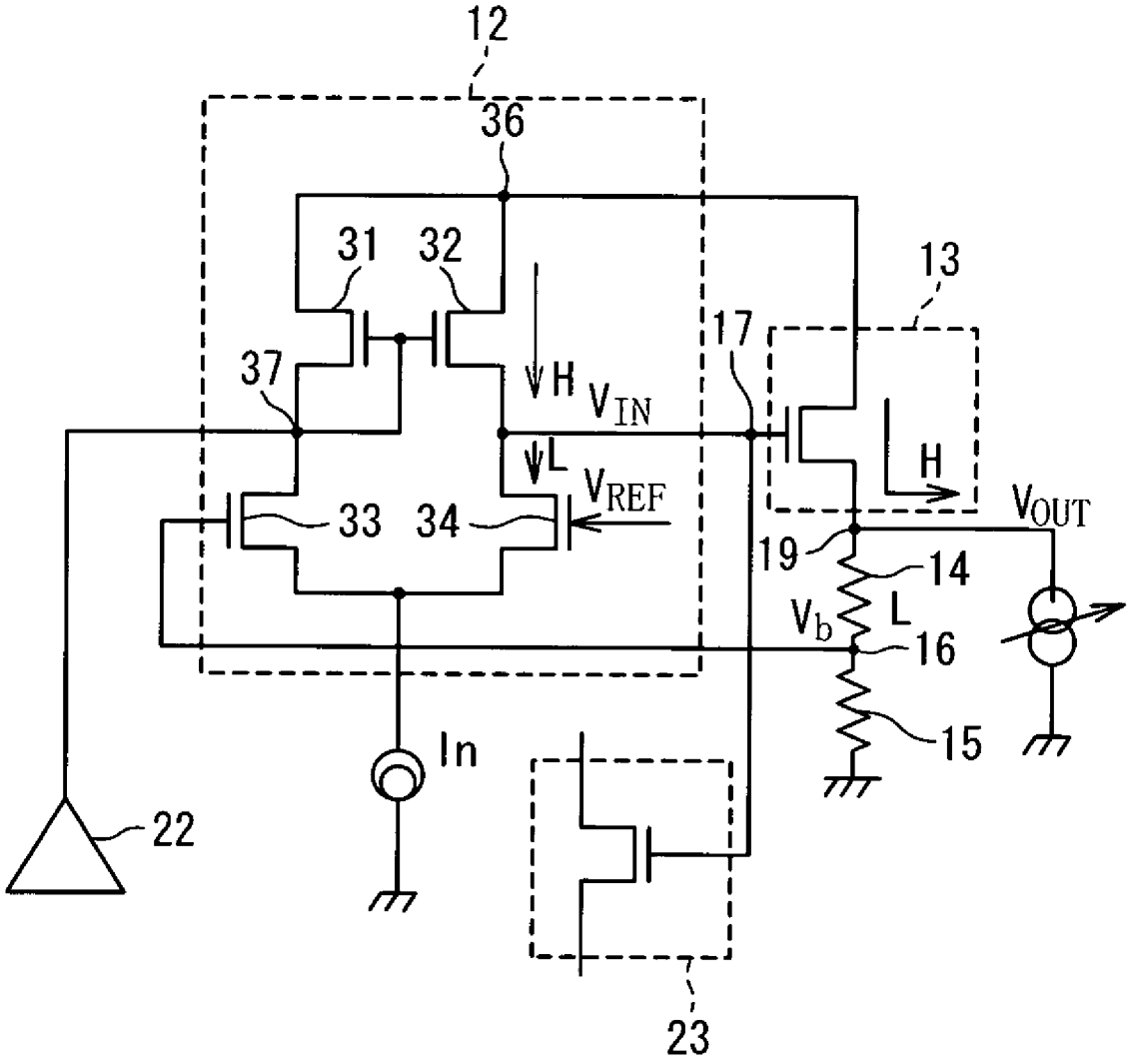
FIG. 4 is a circuit diagram showing the configuration example of the differential amplifier 12.

FIG. 4 is a circuit diagram showing the configuration example of the differential amplifier 12. The differential amplifier 12 changes the gate voltage $V_g$ of the MOS transistor 13 such that the potential of the feedback current from the MOS transistor 13 coincides with the reference voltage $V_{REF}$. However, this voltage control is carried out based on the output voltage of the amplifier 22 supplied to a node 37 (a control terminal). The output voltage of the amplifier 22 is the value based on the potential difference between the voltage $V_a$ and the voltage $V_b$ which are supplied thereto. Thus, the gate voltage $V_g$ of the MOS transistor 13 is controlled to the value based on the potential difference between the voltage $V_a$ and the voltage $V_b$ which are supplied to the amplifier 22.

The feedback voltage $V_b$ is supplied to a gate of a MOS transistor 33. The reference voltage $V_{REF}$ is supplied to a gate of a MOS transistor 34. One of terminals of the MOS transistor 33 is connected with that of the MOS transistor 34 and a ground. Another of the terminals of the MOS transistor 33 is connected with one of terminals of a MOS transistor 31 at the node 37. Another of the terminals of the MOS transistor 34 is connected with one of terminals of a MOS transistor 32 and the gate of the MOS transistor 13. Another of the terminals of the MOS transistors 31 is connected with that of the MOS transistors 32, the fourth terminal of the MOS transistor 13 and the gate of MOS transistor 23. A gate of the MOS transistors 31 is connected with that of the MOS transistors and 32 and the node 37 are connected with each other.

Figure 5:
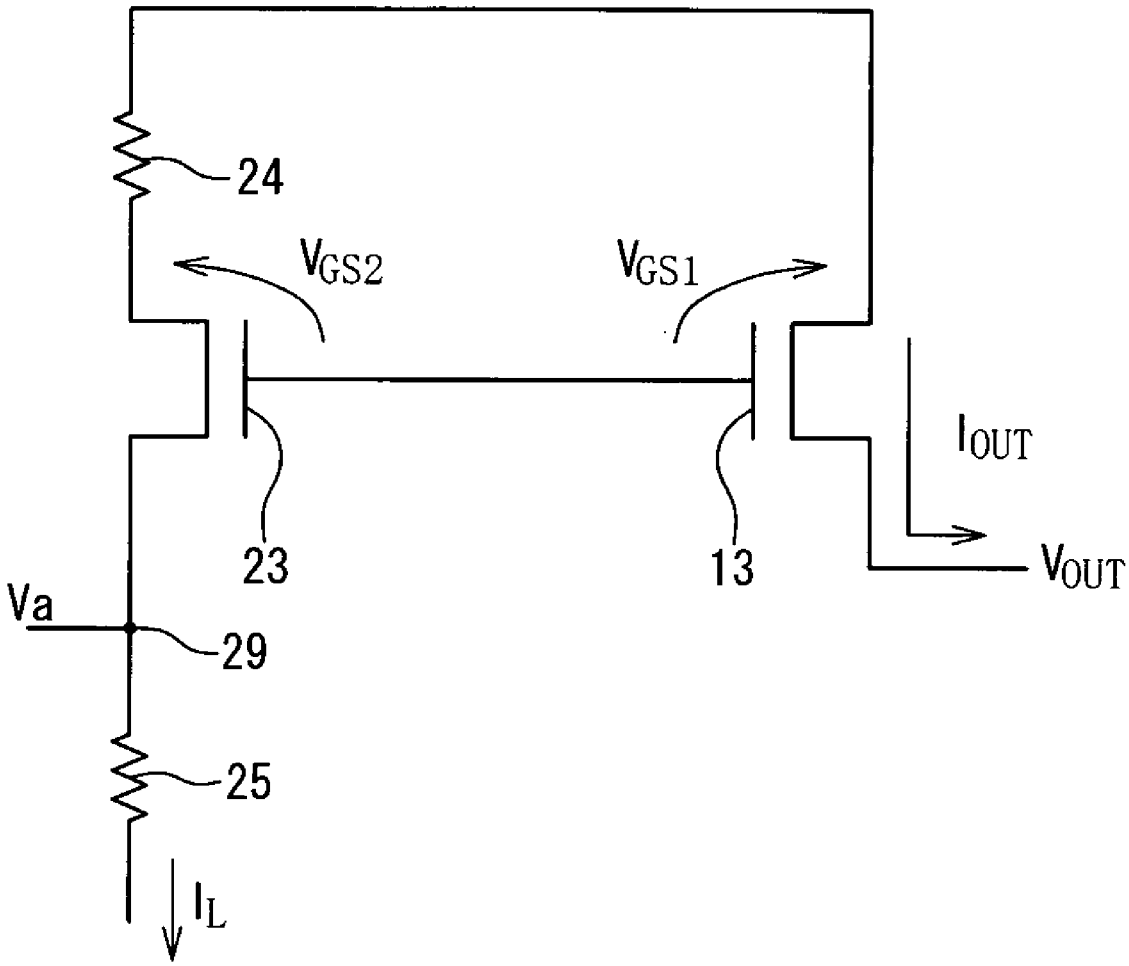
FIG. 5 is a circuit diagram showing the configuration of the main portion of the voltage regulator circuit having the short-circuit protection circuit according to this embodiment.

FIG. 5 is a circuit diagram showing the configuration of the main portion of the voltage regulator circuit having the short-circuit protection circuit according to this embodiment.

In this embodiment, when the current flowing through the MOS transistor 23 is assumed to be a current $I_L$, the relation represented by the equations (2) and (3) is established. Here, $V_{GS1}$, indicates a potential difference between a gate and a source of the MOS transistor 13. $V_{GS2}$ indicates a potential difference between a gate and a source of the MOS transistor 23. $R_{a1}$ indicates a resistance value of the first resistance 24. $R_{a2}$ indicates a resistance value of the second resistance 25.

[Equations (2) and (3)]

$$I_L = \frac{V_a}{R_{a1}} \tag{2}$$

$$V_{GS1} - V_{GS2} = R_{a2} \cdot I_L \tag{3}$$

Also, typically, in the MOS transistor, when $V_{GS}$ represents a potential of a gate electrode and $I_D$ represents a drain current in a case of defining a potential of a source electrode as a reference potential, the relation represented by the equation (4) is established. Here, $V_T$ represents a gate threshold voltage of the MOS transistors 13, 23.

[Equation (4)]

$$I_D = \mu \cdot C_{OX} \cdot \frac{1}{2} \cdot \frac{W}{L} \cdot (V_{GS} - V_T)^2 = k \cdot (V_{GS} - V_T)^2 \tag{4}$$

$$\therefore V_{GS} = \sqrt{\frac{I_D}{k} \cdot \frac{L}{W}} + V_T$$

$$k = \mu \cdot C_{OX} \cdot \frac{1}{2}$$

When the equation (4) is applied to the voltage regulator circuit 1 according to this embodiment, the relation between the potential of the gate electrode and the drain current in the case of defining the potential of the source electrode as the reference potential is represented as follows.

[Equation (5)]

$$V_{SG1} = \sqrt{\frac{I_{OUT}}{k} \cdot \frac{L_1}{W_1}} + V_T, \quad V_{SG2} = \sqrt{\frac{I_L}{k} \cdot \frac{L_2}{W_2}} + V_T \tag{5}$$

When the above $V_{GS1}$ and $V_{GS2}$ in the equation (5) are substituted into the equation (3), the equation (6) is obtained.

[Equation (6)]

$$R_{a2} \cdot I_L = \sqrt{\frac{I_{OUT}}{k} \cdot \frac{L_1}{W_1}} - \sqrt{\frac{I_L}{k} \cdot \frac{L_2}{W_2}} \tag{6}$$

When the equation (6) is modified, the equation (7) is obtained.

[Equation (7)]

$$\sqrt{\frac{I_{OUT}}{k} \cdot \frac{L_1}{W_1}} = R_{a2} \cdot I_L + \sqrt{\frac{I_L}{k} \cdot \frac{L_2}{W_2}} \tag{7}$$

When both sides of the equation (7) are squared, the equation (8) is obtained.

[Equation (8)]

$$\frac{I_{OUT}}{k}\cdot\frac{L_1}{W_1}=(R_{a2}\cdot I_L)^2+2R_{a2}\cdot I_L\cdot\sqrt{\frac{I_L}{k}\cdot\frac{L_2}{W_2}}+\frac{I_L}{k}\cdot\frac{L_2}{W_2} \tag{8}$$

When the equation (8) is modified, the equation (9) is obtained.

[Equation (9)]

$$I_{OUT}=\frac{W_1}{L_1}\cdot k\cdot\left\{(R_{a2}\cdot I_L)^2+2R_{a2}\cdot I_L\cdot\sqrt{\frac{I_L}{k}\cdot\frac{L_2}{W_2}}+\frac{I_L}{k}\cdot\frac{L_2}{W_2}\right\} \tag{9}$$

Here, if the channel length of the MOS transistor 13 is equal to the channel length of the MOS transistor 23 (namely, $L_1=L_2$), the amplifier 22 is operated such that the voltage $V_a$ is equal to the voltage $V_b$ ($V_a=V_b$). Then, when the equation (2) is substituted into the equation (9), the equation (10) is obtained.

[Equation (10)]

$$I_{OUT}=\frac{W_1}{L_1}\cdot k\cdot\left\{\left(\frac{R_{a2}}{R_{a1}}\cdot V_b\right)^2+2\cdot\frac{R_{a2}}{R_{a1}}\cdot V_b\cdot\sqrt{\frac{V_b\cdot L_2}{R_{a1}\cdot W_2\cdot k}}+\frac{V_b\cdot L_2}{R_{a1}\cdot W_2\cdot k}\right\} \tag{10}$$

$$k=\mu\cdot C_{OX}\cdot\frac{1}{2}$$

Thus, in the voltage regulator circuit 1 according to this embodiment, the output current $I_{OUT}$ is represented by the equation (10).

In the equation (10), the first item on the right side (hereafter, merely noted as a first item) includes the resistance value $R_{a2}$ in a numerator and the resistance value $R_{a1}$ in a denominator. Since the first resistance 24 ($R_{a1}$) and the second resistance 25 ($R_{a2}$) are formed on the same substrate, the physical property values of the respective resistances have the similar variations. Namely, if the resistance value $R_{a1}$ is greater by 10% than a design value, the resistance value $R_{a2}$ becomes the value greater by 10% than the design value. Thus, in the first item in which the variation in the resistance value becomes the common factors in the numerator and denominator, the influence caused by the variation in the resistance values is cancelled, and the change is reduced.

In factors of the second item on the right side (hereafter, merely noted as the second item) of the equation (10), as for ($R_{a2}/R_{a1}$), the variation in the resistance values are cancelled similarly to the first item. Also, as for $((V_bL_2)/(R_{a1}W_2k))^{1/2}$, the variation in the resistance value of the resistance $R_{a1}$ acts at the (½) square, which reduces the influence of the variation.

As for the third item on the right side (hereafter, merely noted as the third item) of the equation (10), it is equal to the right side of the equation (1) representing the output current of the voltage regulator 101 having the conventional short-circuit protection circuit 102. Namely, the third item receives the influence caused by the variation in the resistance value of the resistance $R_{a1}$, similarly to the conventional configuration.

The right side of the equation (10) coincides with the right side of the equation (1), if the first and second items become 0 (zero). Here, the case that the first and second items become 0 implies the case that the resistance value of the second resistance 25 ($R_{a2}$) becomes 0. Thus, the existence of the second resistance 25 reduces the ratio occupied by the third item in the right side of the equation (10). The third item is the item that receives the influence of the variation in the resistance value of the first resistance 24 ($R_{a1}$) more than the first and second items. Hence, if the ratio occupied by the components determined by the third item among the components of the output current $I_{OUT}$ is reduced, the influence of the variation of the third item to the output current $I_{OUT}$ is reduced. Namely, the installation of the second resistance 25 reduces the variation in the output current $I_{OUT}$.

Moreover, in the equation (10), if the resistance values $R_{a1}$ and $R_{a2}$ are determined so as to reduce the ratio occupied by the third item, the components that do not receive the influence of the variation in the resistance values occupies most of the output current $I_{OUT}$. Thus, the variation in the output current $I_{OUT}$ becomes small. That is, the third item preferably satisfies the condition that (the third item/(the first item+the second item+the third item)) is nearly equal to 0 as shown in the equation (11).

[Equation (11)]

$$\frac{\left(\frac{V_b\cdot L_2}{R_{a1}\cdot W_2\cdot\frac{\mu\cdot C_{OX}}{2}}\right)}{\frac{W_1}{L_1}\cdot\frac{\mu\cdot C_{OX}}{2}\cdot\left\{\left(\frac{R_{a2}}{R_{a1}}\cdot V_b\right)^2+2\cdot\frac{R_{a2}}{R_{a1}}\cdot V_b\cdot\sqrt{\frac{V_b\cdot L_2}{R_{a1}\cdot W_2\cdot\frac{\mu\cdot C_{OX}}{2}}}+\frac{V_b\cdot L_2}{R_{a1}\cdot W_2\cdot\frac{\mu\cdot C_{OX}}{2}}\right\}}\approx 0 \tag{11}$$

Actually, if (the third item/(the first item+the second item+the third item)) is equal to or less than 0.1, the influence of the manufacture variation in the first resistance 24 on the output current $I_{OUT}$ can be substantially ignored. In the voltage regulator circuit, the output current $I_{OUT}$ is the design value. Thus, by determining the resistance value of the second resistance 25 within the range where the above-described equations (2) to (10) are established, the resistance value of the resistance 24 is also determined.

Figure 6:
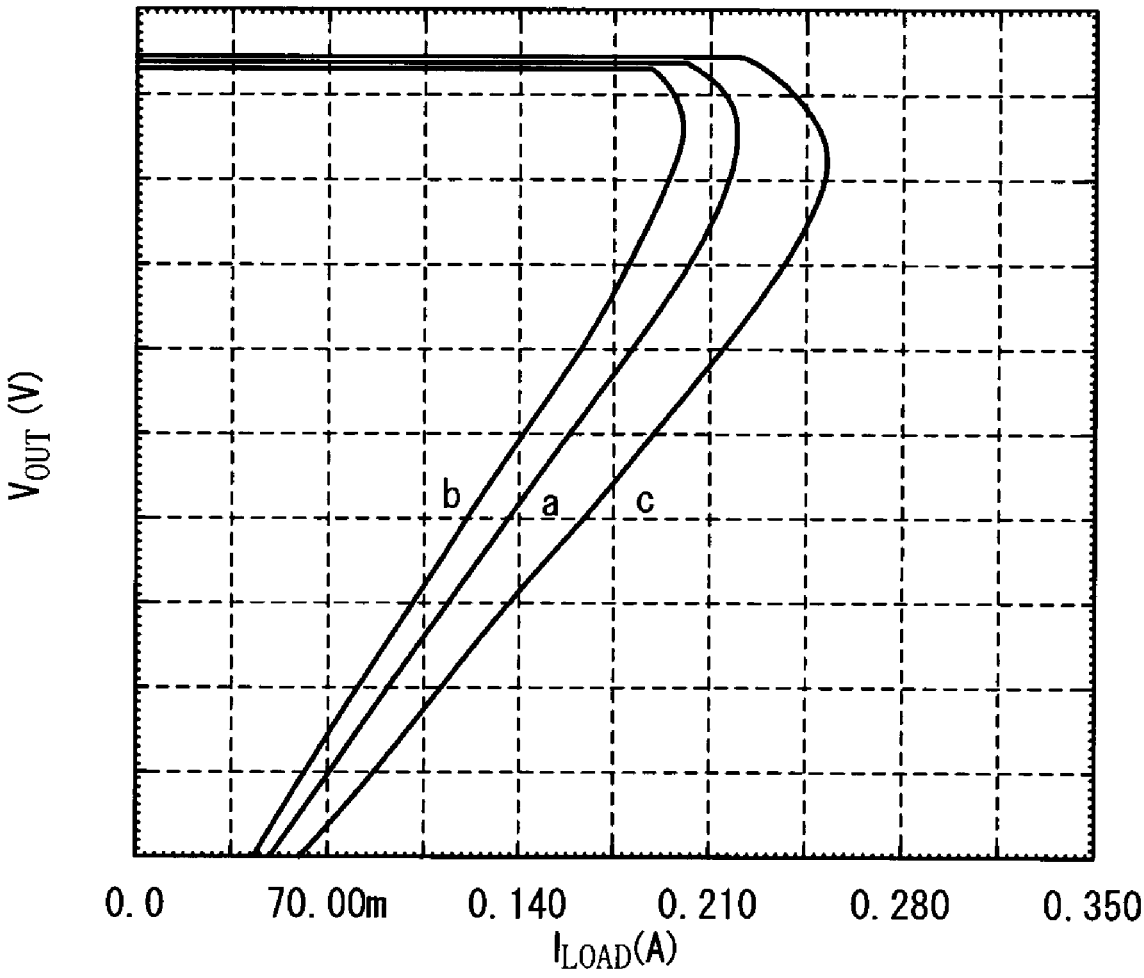
FIG. 6 is a graph showing the output property of the voltage regulator circuit having the short-circuit protection circuit according to this embodiment.

FIG. 6 is a graph showing the output property of the voltage regulator circuit having the short-circuit protection circuit according to this embodiment. Incidentally, a curve "a" in the graph indicates a designed standard value of a short-circuit current, a curve "b" in the graph indicates the minimum condition of the short-circuit current, and a curve "c" in the graph indicates the maximum condition of the short-circuit current.

As illustrated, in this embodiment, it is found that even if the resistance value of the resistance has the variation, the variation in the output current $I_{OUT}$ from the driver is small, and the variation in the resistance value of the resistance is less influenced than that in the conventional circuit configuration.

In this way, in the voltage regulator circuit 1 having the short-circuit protection circuit 3 according to this embodiment, the output current $I_{OUT}$ of the driver is not determined by the resistance values of the voltage division resistances 24 and 25, and it is determined by the relative ratio between them. Thus, the output current $I_{OUT}$ of a driver (the MOS transistor 13) is not easily influenced by the variation in the resistance value of the resistance.

Incidentally, the above-described embodiment is one example of the preferred embodiment in the present invention. It is apparent that the present invention is not limited to the above embodiment, that may be modified and changed without departing form the scope and spirit of the invention. For example, the configuration of the differential amplifier 12 illustrated in the embodiment is only one example. The present invention is not limited thereto. Also, in the embodiment, the present invention has been explained by exemplifying the configuration of using the MOS transistor. However, without any limitation to the MOS transistor, a bipolar transistor and the like can be applied. In this way, in the present invention, the various variations are possible.

What is claimed is:

1. A voltage regulator circuit comprising:

a regulator circuit; and a short-circuit protection circuit, wherein said regulator circuit includes:

a first transistor, and a first amplifier which outputs a gate voltage to a gate of said first transistor in response to an input of a reference potential and a feedback potential such that said feedback potential coincides with said reference potential, said feedback potential is an output potential of first transistor fed back to said first amplifier, said short-circuit protection circuit includes:

a second transistor that said gate voltage is supplied to a gate, a first resistance which connects a first terminal of said second transistor with a ground, a second resistance which connects a second terminal of said second transistor with a power source, and a second amplifier which outputs a control voltage to said first amplifier in response to an input of a bias potential and a potential of said first terminal to control said gate voltage.

2. The voltage regulator circuit according to claim 1, wherein an output current of said first transistor is determined based on a ratio of a resistance value of said first resistance and a resistance value of said second resistance.

3. The voltage regulator circuit according to claim 1, wherein said bias potential is generated from dividing said output potential of said first transistor by using voltage dividing resistances.

4. The voltage regulator circuit according to claim 1, wherein said first resistance and said second resistance are formed on the same substrate.

5. The voltage regulator circuit according to claim 1, wherein one of input terminals of said second amplifier is connected with said first terminal, said bias potential is supplied to another of the input terminals of said second amplifier, and an output terminal of said second amplifier is connected with a control terminal of said first amplifier.

6. The voltage regulator circuit according to claim 5, wherein said regulator circuit further includes:

a third resistance of which one of terminals is connected with an output terminal of said first transistor, and a fourth resistance of which one of terminals is connected with another of the terminals of said third resistance, and another of the terminals is connected with a ground, one of input terminals of said first amplifier is connected with a first connection point with which said third resistance and said fourth resistance are connected, another of the input terminals of said first amplifier is connected with an reference power source which outputs said reference potential, and an output terminal of said first amplifier is connected with the gate of said first transistor, said bias potential is a potential at said first connection point.

7. The voltage regulator circuit according to claim 6, wherein said another of the input terminals of said second amplifier is connected with said first connection point.

8. The voltage regulator circuit according to claim 1, wherein said first transistor and said second transistor are MOS transistors.

9. The voltage regulator circuit according to claim 8, wherein an relational expression (a) shown below is satisfied in said voltage regulator circuit, in the case that a resistance value of said first resistance is R1, a resistance value of said second resistance is R2, said feedback potential is V, a channel width of said first transistor is W1, a channel length of said first transistor is L1, a channel width of said second transistor is W2, a channel length of said second transistor is L2, a capacity of gate insulating films of said first transistor and said second transistor is $C_{OX}$, an electron mobility of said first transistor and said second transistor is μ.

$$\frac{\dfrac{V \cdot L_2}{R_1 \cdot W_2 \cdot \dfrac{\mu \cdot C_{ox}}{2}}}{\dfrac{W_1}{L_1} \cdot \dfrac{\mu \cdot C_{ox}}{2} \cdot \left\{ \left(\dfrac{R_2}{R_1} \cdot V\right)^2 + 2 \cdot \dfrac{R_2}{R_1} \cdot V \cdot \sqrt{\dfrac{V \cdot L_2}{R_1 \cdot W_2 \cdot \dfrac{\mu \cdot C_{ox}}{2}}} + \dfrac{V \cdot L_2}{R_1 \cdot W_2 \cdot \dfrac{\mu \cdot C_{ox}}{2}} \right\}} \approx 0 \quad \text{(a)}$$

10. A method for operating a voltage regulator circuit, wherein said voltage regulator circuit including:

a regulator circuit; and a short-circuit protection circuit, wherein said regulator circuit includes:

a first transistor which includes a first gate, a third terminal outputting a output current, and a fourth terminal, and a first amplifier which includes a first output terminal connected with said first gate, a third input terminal connected with said third terminal such that a feedback potential corresponding to an output potential of said third terminal is fed back, and a fourth input terminal connected with a reference power source that supplies a reference potential, said short-circuit protection circuit includes:

a second transistor which includes a second gate connected with said first output terminal, a first terminal and a second terminal, a first resistance which connects said first terminal with a ground, a second resistance which connects said second terminal with a power source, and a second amplifier which includes a second output terminal connected with a control terminal of said first amplifier, a first input terminal connected with said first terminal, and a second input terminal connected with said third terminal such that said feedback potential is supplied, said method comprising:

(a) outputting said output current from said third terminal;

(b) supplying said feedback potential to said third input terminal, and said reference potential to said fourth input terminal; and (c) outputting a gate voltage from said first output terminal to said first gate based on a potential of said first terminal and said feedback potential such that said feedback potential coincides with said reference potential.

11. The method for operating a voltage regulator circuit according to claim 10, wherein said step (c) includes:

(c1) supplying said gate voltage to said second gate, (c2) supplying said potential of said first terminal to said first input terminal, and said feedback potential to said second input terminal, and (c3) outputting a control voltage from said second output terminal to said first amplifier based on said potential of said first terminal and said feedback potential, said control voltage controls said gate voltage such that said feedback potential coincides with said reference potential.

12. The method for operating a voltage regulator circuit according to claim 11, wherein said first transistor and said second transistor are MOS transistors, and an relational expression (a) shown below is satisfied in said voltage regulator circuit, in the case that a resistance value of said first resistance is R1, a resistance value of said second resistance is R2, said feedback potential is V, a channel width of said first transistor is W1, a channel length of said first transistor is L1, a channel width of said second transistor is W2, a channel length of said second transistor is L2, a capacity of gate insulating films of said first transistor and said second transistor is $C_{OX}$, an electron mobility of said first transistor and said second transistor is μ.

$$\frac{\dfrac{V \cdot L_2}{R_1 \cdot W_2 \cdot \dfrac{\mu \cdot C_{ox}}{2}}}{\dfrac{W_1}{L_1} \cdot \dfrac{\mu \cdot C_{ox}}{2} \cdot \left\{ \left( \dfrac{R_2}{R_1} \cdot V \right)^2 + 2 \cdot \dfrac{R_2}{R_1} \cdot V \cdot \sqrt{\dfrac{V \cdot L_2}{R_1 \cdot W_2 \cdot \dfrac{\mu \cdot C_{ox}}{2}}} + \dfrac{V \cdot L_2}{R_1 \cdot W_2 \cdot \dfrac{\mu \cdot C_{ox}}{2}} \right\}} \approx 0 \quad \text{(a)}$$

* * * * *